US005918823A

United States Patent [19]

Strasser et al.

[11] Patent Number: 5,918,823

[45] Date of Patent: Jul. 6, 1999

[54] HIGH-PRESSURE ROLLER PRESS FOR PRESSURE COMMINUTION OF GRANULAR PRODUCT

[75] Inventors: Siegfried Strasser, Much; Franz Göddecke, Leverkusen, both of Germany

[73] Assignee: Deutz Aktiengesellschaft, Köln, Germany

[21] Appl. No.: 08/844,583

[22] Filed: Apr. 21, 1997

[30] Foreign Application Priority Data

Apr. 19, 1996 [DE] Germany ..... 196 15 479
Jul. 30, 1996 [DE] Germany ..... 196 30 687

[51] Int. Cl.[6] ..... B02C 23/22

[52] U.S. Cl. ..... 241/61; 241/79.1; 241/80; 241/97

[58] Field of Search ..... 341/80, 97, 79.3, 341/57, 79.1, 60, 61

[56] References Cited

U.S. PATENT DOCUMENTS 2,138,715 11/1938 Thorsen ..... 241/97
2,552,360 5/1951 Zichis ..... 241/97
4,134,556 1/1979 Ehrlich et al. ..... 241/80

FOREIGN PATENT DOCUMENTS 939301 2/1956 Germany ..... 241/97
35 18 543 3/1993 Germany .

OTHER PUBLICATIONS

KHD Humboldt Wedag Literature entitled "Roillenpressen" 2–300 d (2 sheets—cover and p. 5).

*Primary Examiner*—Mark Rosenbaum
*Attorney, Agent, or Firm*—Hill & Simpson

[57] ABSTRACT

A product bed comminution high-pressure roller press wherein the problem of great recirculations of product material or, respectively, high product circulation rates caused, for example, because of reduced roller press pressures is solved employing little machine outlay. Two rollers (10, 11) are surrounded by a housing composed of two stationary lateral end walls (12, 13) between which a rotatably seated material conveying ring (16) that can be rotated is arranged for an internal product material circulation. The product material is admitted from the side through one or more openings (22) in one or in both housing end walls (12, 13) and the product material is discharged laterally through one or more openings (24) in the housing end walls (12, 13) via a discharge element (25) and/or via one or more discharge elbows (27).

21 Claims, 4 Drawing Sheets

HIGH-PRESSURE ROLLER PRESS FOR PRESSURE COMMINUTION OF GRANULAR PRODUCT

FIELD OF THE INVENTION

The invention is directed to a high-pressure roller press for the pressure comminution of granular product, and more particularly to a high-pressure roller press having two oppositely driven rollers that are separated from one another by a nip.

BACKGROUND OF THE INVENTION

In the pressure comminution of granular grinding stock in the nip between two press rollers, one of the rollers is fashioned as a loose roller whose bearing blocks are supported against hydraulic cylinders with which the roller pressing power is exerted. The charging stock supplied to the nip must be seized by the oppositely driven rollers and be drawn into the nip by friction. The individual particles of the grinding stock drawn into the nip are thereby mutually crushed in a product bed, i.e. in a material fill compressed between the two roller surfaces given application of a high-pressure, so that one thereby speaks of what is referred to as product bed comminution. In the grinding stock, the high-pressure pressing leads partly to particle destruction, partly to the creation of incipient cracks in the insides of particles, and is visibly expressed in the formation of agglomerates (or what are referred to as scabs). These agglomerates can be deagglomerated or, respectively, loosened with comparatively little energy expenditure, so that this type of comminution is characterized overall by a comparatively low specific energy requirement.

For improving the product draw-in capability and product pressing capability and for enhancing the grinding capacity or interparticle crushing of the product bed roller press, it has also been disclosed to recirculate a sub-stream of the scab material or agglomerate discharged from the roller press directly to the delivery shaft of the roller press. This recirculation process is shown in brochure 2-300 d"Rollenpressen" of KHD Humboldt Wedag AG at page 5, as well as in German Patent DE-C 35 18 543. The product material recirculated in the process is thereby subjected to the high-pressure pressing stress several times in succession.

On the other hand, there is currently a tendency to lower the pressing power of the high-pressure roller press, for example from 10 N/mm$^2$ to 5 N/mm$^2$ (1450 lb./in$^2$ to 725 lb./in$^2$). This is done in order to thus alleviate the problems of wear of the roller surfaces or, respectively, the stability of the rollers under load that are associated with the high-pressure pressing. Particularly in what is referred to as finished and semi-finished grinding, the product bed roller press works in circulation with a sifter or sifter means.

A lowering of the pressing power in the nip of the roller press in product bed comminution results in high grinding circulation rates or cycles of the roller press or, respectively, great quantities of circulating scab material. This further results in a substantial outlay to convey the discharged product of the press and the grits sifted from the discharge of the roller press back to the press delivery shaft via the sifter or directly to the press delivery shaft. This is, for example, done using bucket conveyors, as a result whereof the high energy savings connected with the product bed comminution process can again be placed in question. In addition to requiring drive energy, such bucket conveyors also need much space for their installation.

SUMMARY OF THE INVENTION

The invention is a product bed comminution high-pressure roller press wherein the problem of great product material recirculations or high circulation rates caused, in particular, by reduced roller pressing powers is solved. The invention does so employing relatively little apparatus outlay, and by integrating the product material circulation and, as needed, the sifting process in a compact unit.

In the inventive product bed comminution roller press, the two rollers are housed within a housing composed of two stationary, i.e. non-rotating, lateral end walls. A rotatably seated material conveyor ring that can be rotated by a rotatory drive is arranged between the end walls for an internal circulation of product material. This rotatably seated material conveyor ring of the housing rotates at, for example, about 40 to 80% of the critical centrifugal speed of the ring, dependent on the design of lifter elements in the conveyor ring. The ring entrains the press discharge material (scab material) up to a point before and after the upper apex of the ring and lets this product material fall into the nip, creating the internal product material circulation. Bucket conveyors or other space-consuming conveyor elements for conveying the press discharge material to the press admission are eliminated. Recirculation of the material within the housing results in repeated product bed stressing of the product material and is inventively achieved in the smallest space and with little apparatus outlay. The comparatively high product circulation loads which are produced by reduced roller pressing powers in view of the stability of the rollers under load that is thereby enhanced can also be unproblematically governed with the invention.

In the inventive high-pressure roller press, the admission for the fresh material and, potentially, for grits recirculated from a sifter that follows outside the rotating housing ensues through at least one, and preferably two openings that are arranged lying opposite one another in the housing end walls. After internal product circulation, the product material discharge from the housing ensues through an opening in the housing end wall laterally beneath the nip toward the outside, for example with a product chute, vibration conduit or the like. The fresh product delivery thus does not occur centrally from above but laterally proceeding from one or from both ends of the rollers.

When the material admission ensues at only one side wall while it is being circulated by the rotatably seated material conveying ring, the grinding stock is thereby also moved overall within this material conveying ring in an axial direction toward end wall of the opposite housing side and is discharged thereat through the discharge opening. When material admission is from both sides, the material is moved in an axial direction to the middle of the roller and may also be discharged from the middle of the roller in this case, for example through a shaking pipe conveyor. The upper part of the rotating housing can be flooded with fresh air for cooling or with hot gas for drying.

A sifting of the material which falls from the material conveying ring before it enters into the nip for further grinding may be achieved by a suitable arrangement of a gas stream admission and discharge. The material discharge can also ensue completely with the gas stream. The selected gas velocity in the rotary housing determines the fineness of the pneumatically discharged fine product. For example, the fine product can be separated in cyclones and further-ground (for example, in a ball mill), or it can be supplied to an external sifter where the separation into finished product and grits ensues. These grits are then resupplied to the nip via the opening(s) in the housing end walls.

This externally implemented sifting process for achieving increasingly fine particles can also ensue in the rotary housing of the high-pressure roller press with a horizontally disposed rod basket of a basket-type rod sifter that is arranged above the roller press. The press discharge product falling from the material conveying ring is partly seized by the gas stream that enters through a plurality of openings in the end walls and supplied to the rod basket and is partly directly supplied to the rod basket. The fine product with the desired fineness—set by the speed of the rod basket and the gas velocity—is separated from unfinished product by flowing through the rod basket and emerges at one or more openings in the end walls together with the gas stream. The fine product is then deposited in cyclones or in a filter.

BRIEF DESCRIPTION OF THE DRAWINGS

The invention and the further features and advantages thereof are explained in greater detail on the basis of the exemplary embodiment schematically shown in the FIGS. Shown are.

DETAIL DESCRIPTION OF THE PREFERRED EMBODIMENT

Figure 1:
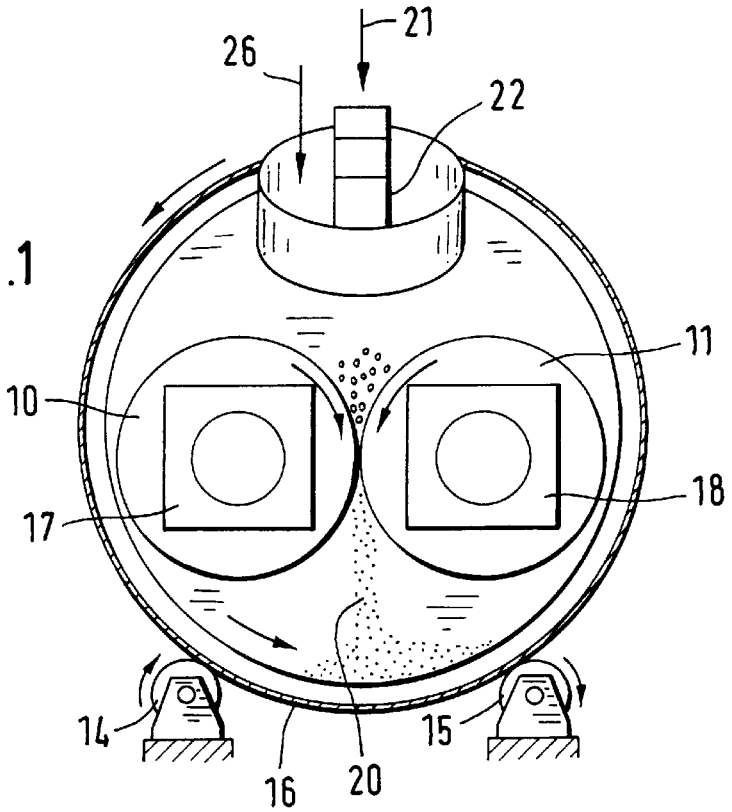
FIG. 1 is a high-pressure roller press of the invention, shown partially in elevation with one of the end walls partially cut away.

In the inventive high-pressure roller press for product bed comminution of granular product material, two oppositely driven rollers 10, 11 separated from one another by a nip are surrounded by a housing. The housing is composed of two stationary, non-rotating lateral end walls 12, 13 between which a material conveyor ring 16 is rotatably seated. The outer surface of the conveyor ring rests on bearing rollers 14 and 15 and is arranged for an internal rotational circulation of product material. The rotation of the material conveying ring 16 ensues via contact with the cylindrical jacket or external surface thereof, with, for example, the driven bearing roller 15. In the exemplary embodiment, bearing blocks 17, 18, of the two rollers 10, 11 are arranged outside the stationary lateral end walls 12, 13 of the housing and are seated in a machine frame (not shown here).

The inside wall or surface of the rotatably seated material conveying ring 16 that is rotated can be provided with lifter elements 19 for creating or enhancing the internal circulation of product material. At any rate, the material conveying ring 16 rotates with a speed that lies below what is referred to as the critical centrifugal speed so that the ring 16 entrains the discharged product of the press (which is schematically indicated with 20 in FIG. 1) up to a point just preceding the upper apex of the ring 16 and lets this product material drop from above into the nip between the two rollers 10, 11. On the basis of a suitable structural design of the lifter elements 19 and selection of the speed of the conveying ring 16, the material can also be thrown off subsequent to the upper apex as well. The rotary drive of the conveying ring 16 is preferably implemented as a speed-controllable device. It is also possible to allow the conveying ring 16 to rotate above the critical speed and to strip the product material from the conveying ring in the region of the upper apex.

Figure 2:
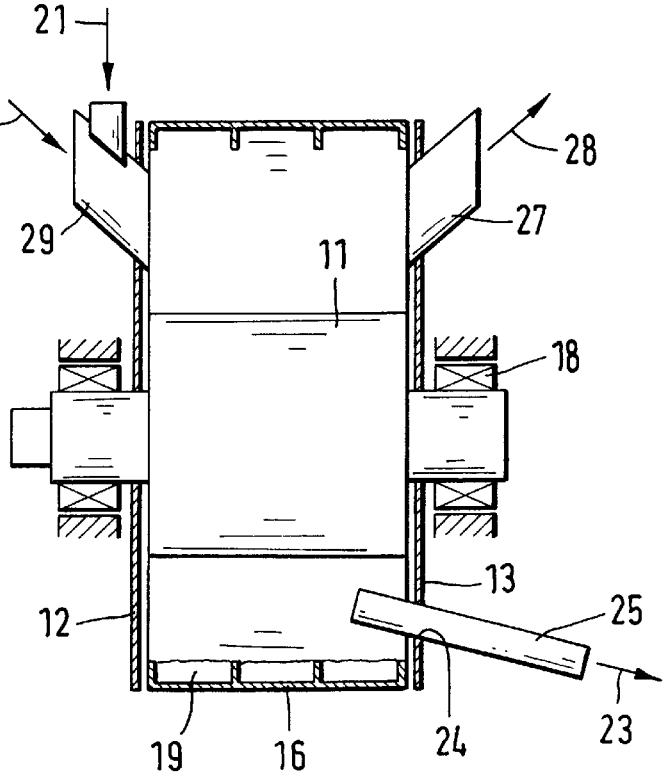
FIG. 2 is the high-pressure roller press of FIG. 1 in a vertical section along a plane through the nip.
Figure 3:
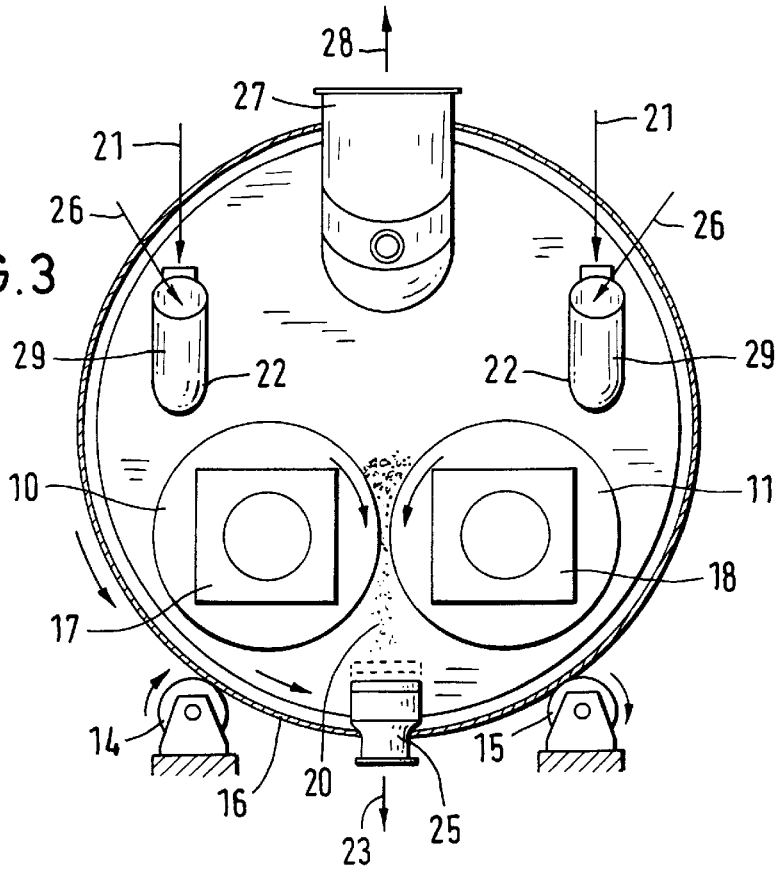
FIG. 3 is an end view of a high-pressure roller press of the invention with one end wall partially cut away and material delivery and gas admission and discharge through both housing end walls, with material discharge proceeding from under the roller middle, and with a rod basket of an integrated, dynamic basket-type rod sifter that is arranged above the rollers.
Figure 4:
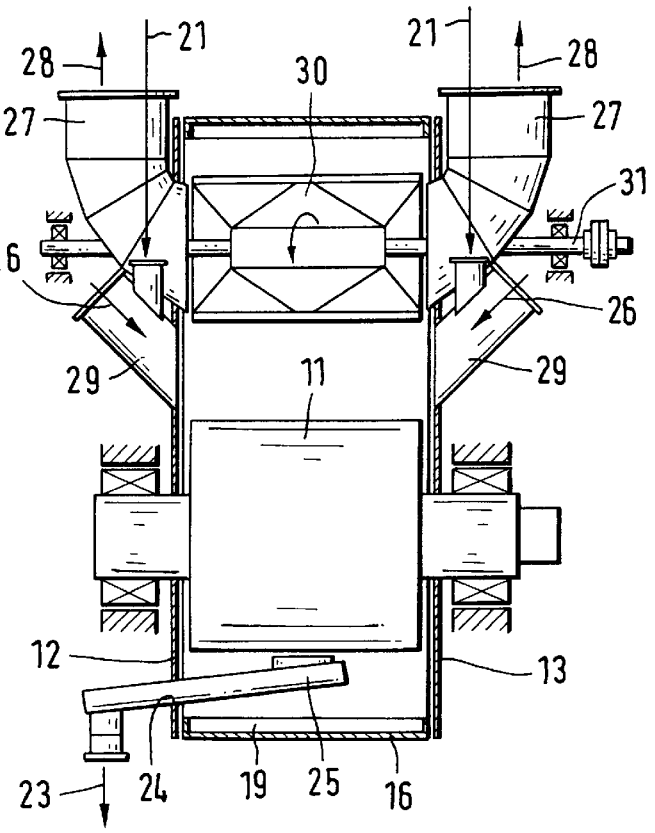
FIG. 4 is a front sectional view of the roller of FIG. 3 taken along line 4—4.

The product admission 21 for the fresh material as well as for potentially recirculated grits collected in a subsequent sifter enters from the side through one or more openings 22 in one or in both housing end walls 12, 13. The product material discharge 23 for outward transfer of the fine ground material from the internal material circulation exits through an opening 24 in the housing end wall 12, 13 laterally beneath the nip. This is accomplished by a product material chute or vibrating conduit 25 (FIG. 2) or, respectively, vibrating conduit pipe 25 (FIG. 4) and/or pneumatically through one or more discharge openings or, respectively, discharge elbows 27. The product discharge element 25 could also be arranged above the press rollers.

In the inventive high-pressure roller press, the fresh product delivery therefore does not ensue centrally from above onto the nip, but laterally proceeding from one or from both ends of the rollers. The product material, which is pre-ground after passing the nip, is conveyed up with the rotation of the material conveying ring 16 and is resupplied to the grinding rollers for further grinding or repeated high-pressure pressing is discharged. Overall, the grinding stock thereby also moves in an axial direction toward the opposite roller ends or, given delivery of material from both sides, moves toward the middle, especially when a material fill builds up over the nip. This finished material is discharged from the machine via the discharge element 25 after multiple high-pressure pressing stresses, either proceeding from the edge or from the roller middle.

The lateral end walls 12, 13 of the housing can include one or more openings 29 for entry flow 26 of a gas stream and one or more openings 27 for discharge flow 28 of the gas stream. In this way, the housing in which the two press rollers 10, 11 are housed can, dependent on the demands, be charged either with fresh air or with hot gases, so that the circulating grinding stock can thus be cooled or dried as well. As a result of the air flowing transversely through the housing relative to the upper product material dump, fine material that has already been released from the apex can be sifted out and be discharged together with the discharge flow 28 and delivered to a separator or sifter, whereas the coarse unfinished product remains in the housing. The gas velocity in the housing can thus be increased to such an extent that the material discharge ensues exclusively with the gas flow eliminating the need for discharge elements located below the nip.

When higher demands require a finer product that is sifted out, a dynamic sifting can easily be achieved inside the press housing with a rod basket 30 arranged horizontally above the press rollers that, for example, is mounted on a shaft 31 and driven by a variable-speed electric motor. In this case, the press housing is the sifter housing at the same time. The grits separated out by the rod basket are directly supplied to the rollers 10, 11 lying there below and reground. Given a press housing with rotating conveying ring and integrated rod basket implemented in this way, only the fine product flowing through the rod basket 30 and the elbow(s) 27 need be deposited in cyclones or in a filter.

Fundamentally, there is also the possibility in the inventive roller press of also arranging the product admission to the material conveying ring 16 below the rollers 10, 11. The mechanical material discharge with a chute or vibrating conveyor 25 can also alternatively be arranged above the rollers.

Figure 5:
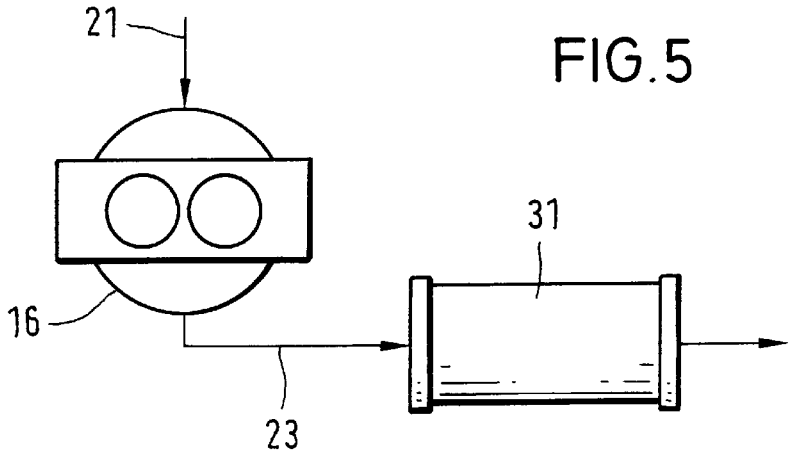
FIG. 5 is a schematic view of one embodiment of a material circuit arrangement of a grinding system with employment of the inventive high-pressure roller press.
Figure 6:
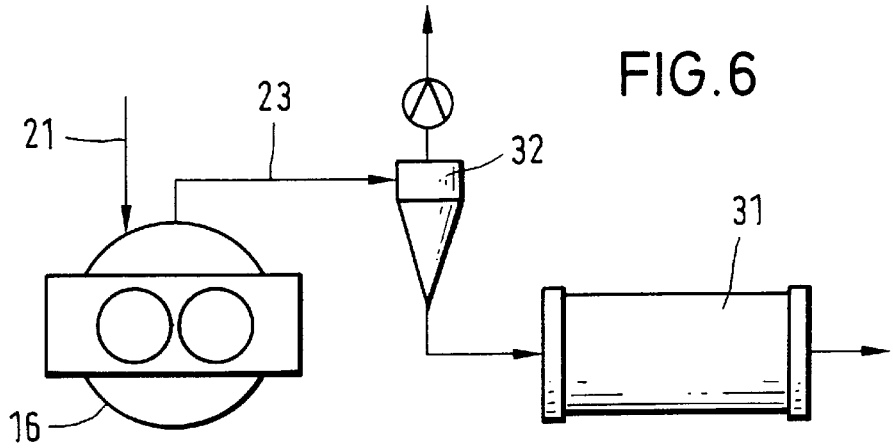
FIG. 6 is a schematic view of another embodiment of material grinding circuit.
Figure 7:
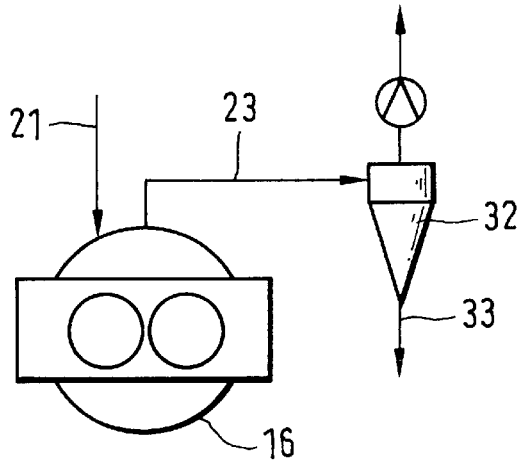
FIG. 7 is a schematic view of another embodiment of material grinding circuit.
Figure 8:
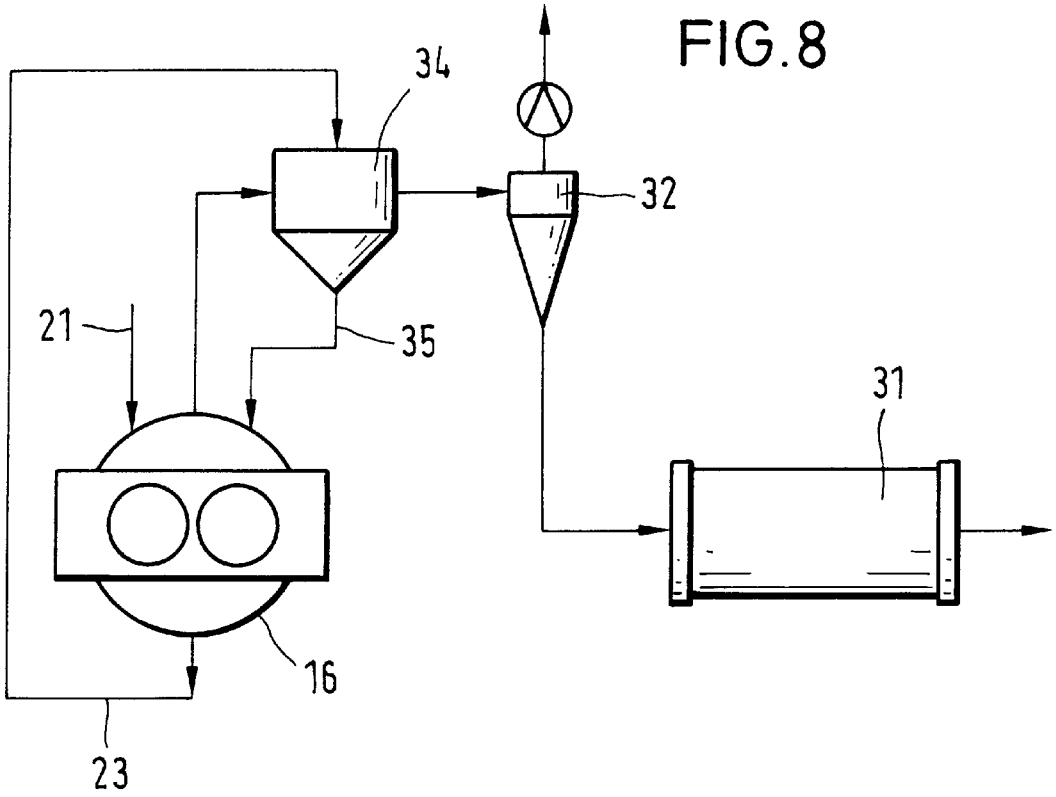
FIG. 8 is a schematic view of another embodiment of material grinding circuit; and, FIG. 9 is a schematic view of another embodiment of material grinding circuit.
Figure 9:
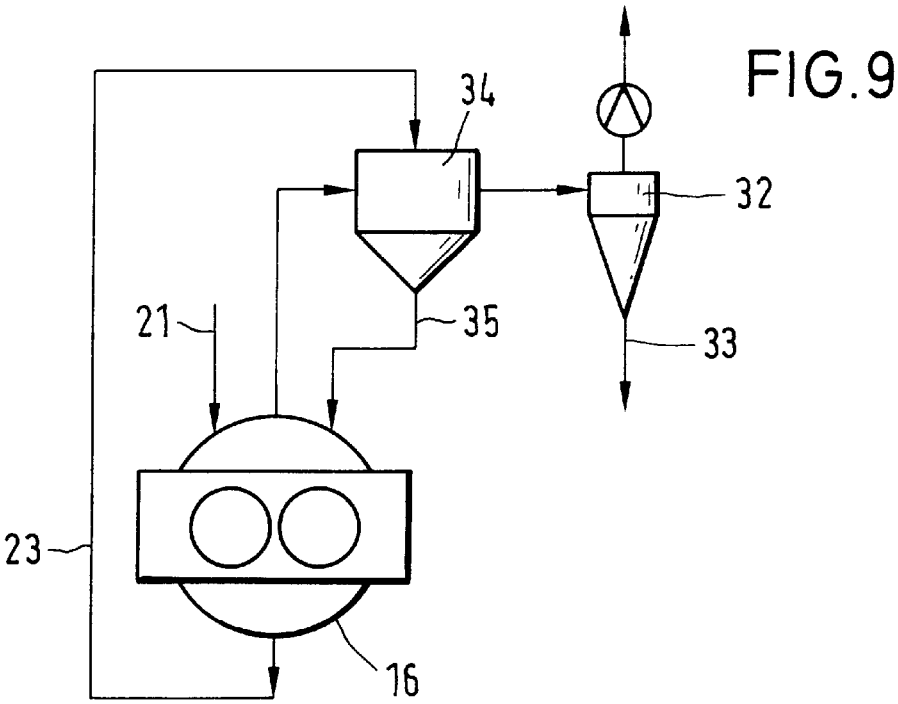

As the various grinding system circuit diagrams of FIGS. 5 through 9 show, the inventive high-pressure roller press with the rotatably seated material conveying ring 16 can, according to FIG. 5, be utilized for pre-grinding. The product material 23 discharged from the pregrinding with internal material circulation is ground further in a second grinding stage, for example a ball mill 31. FIG. 6 shows the semi-finished grinding in the high-pressure roller press with internal material circulation and with integrated sifting means. The discharged product material 23 is separated from the gas stream in a cyclone separator 32 and, for example, further-ground in the ball mill 31. FIG. 7 shows the finish-grinding in the high-pressure roller press with internal material circulation and with integrated sifting means. The finished product 33 is thereby separated directly ill the cyclone separator 32. FIG. 8 shows the semi-finished grinding in the inventive high-pressure roller press with external sifter 34, with mechanical and/or pneumatic external material circulation, cyclone separator 32 and ball mill 31. FIG. 9 shows the finish-grinding in the inventive roller press with external sifter 34, with mechanical and/or pneumatic external material circulation and with cyclone separator 32 for separating the finished product 33.

In the case of the semi-finish grinding or finish-grinding with external sifter 34 according to FIGS. 8 and 9, the grinding stock 23 discharged from the roller press is supplied to the sifter 34 or some other classifier from which the coarse product (grits) can be resupplied to the inventive roller press in an external grinding circulation for further grinding, whereby the grinding stock 23 can be supplied to the sifter 34 either mechanically via the conveyor 25 and/or pneumatically via the discharge elbows 27. In the case of a semi-finish grinding or finish-grinding with sifter integrated in the roller press housing (FIGS. 6 and 7), the circulation of the product material ensues exclusively with the rotating material conveying ring 16. The grits separated by the integrated basket-type rod sifter 30 thereby fall directly into the nip lying there below.

The control of the fresh product delivery 21 to the inventive high-pressure roller press can advantageously ensue dependent on the power consumption of the drive of the material conveying ring 16.

In addition to being employable for roller presses, the invention can also be employed for roll type crushers or cylinder crushers that usually work with a lower roller pressing power than roller presses.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim:

1. A high-pressure roller press for pressure comminution of granular product material, said roller press comprising:

a housing having a pair of spaced apart stationary lateral end walls and a conveyor ring rotatably seated in and extending there between;

a pair of rollers axially spaced from one another and extending between said lateral end walls, said rollers defining a nip between one another and being adapted for rotation in opposite directions;

at least one product material admission for admitting said granular product material into said housing;

at least one product material discharge for discharging comminuted granular product material from said housing; and wherein said conveyor ring is adapted to recirculate said granular product material within said housing and deliver said granular product material to said nip one or more times for pressure comminution.

2. The high-pressure roller press of claim 1 wherein said at least one product material discharge comprises a discharge opening in at least one of said lateral end walls and a discharge element adapted to pass comminuted granular product material through said discharge opening to the exterior of said housing.

3. The high-pressure roller press of claim 2 wherein said at least one product material discharge is located below said nip.

4. The high-pressure roller press of claim 2 further comprising at least one discharge opening in each said lateral end walls.

5. The high-pressure roller press of claim 2 wherein said discharge element is of a type selected from a group comprising a pipe conveyor, a chute and a vibrating conduit.

6. The high-pressure roller press of claim 1 wherein said at least one product material discharge comprises a discharge opening formed in one of said lateral end walls above said nip and a discharge elbow adapted to pneumatically discharge comminuted granular product material from said housing.

7. The high-pressure roller press of claim 6 further comprising at least one discharge opening in each of said lateral end walls.

8. The high-pressure roller press of claim 1 wherein each roller of said pair of rollers is supported on opposite ends by bearing blocks arranged adjacent said lateral end walls on the exterior of said housing.

9. The high-pressure roller press of claim 1 wherein said conveyor ring comprises an exterior jacket and is rotated by contact against said exterior jacket with one or more driven bearing rollers.

10. The high-pressure roller press of claim 9 wherein an amount of said granular product material entering said housing via said at least one product material admission is controlled by at least one of said driven bearing rollers whereby said at least one driven bearing roller includes a pressure cell for measuring the amount of material within said housing.

11. The high-pressure roller press of claim 1 wherein said conveyor ring comprises an inside wall having a plurality of lifter elements carried thereon adapted for recirculating said granular product material within said housing from below said nip to above said nip and for releasing said granular product material onto said nip.

12. The high-pressure roller press of claim 1 wherein said conveyor ring rotates at a speed such that said granular product material is entrained by said conveyor ring from a position below said nip to a position above said nip and is released onto said nip.

13. The high-pressure roller press of claim 1 wherein said lateral end walls each include one or more openings permitting a gas stream to flow through said housing entering via said one or more openings in one of said lateral end walls and discharging via said one or more openings in the other of said lateral end walls.

14. The high-pressure roller press of claim 13 wherein said granular product material is sifted by said gas stream such that comminuted granular product material which is suitably fine is carried by said gas stream discharged from said housing.

15. The high-pressure roller press of claim 14 wherein said product material discharge comprises exclusively said gas stream.

16. The high-pressure roller press of claim 13 further comprising a rotatable rod basket disposed above said nip within said housing for sifting said product material by permitting only comminuted granular product which is suitably fine to pass through said rod basket and be discharged from said housing.

17. The high-pressure roller press of claim 1 wherein said conveyor ring is rotatably driven by a variable-speed drive mechanism.

18. The high-pressure roller press of claim 1 wherein an amount of said granular product material entering said housing via said at least one product material admission is controlled dependent upon power consumption of a variable speed drive mechanism of said conveying ring.

19. The high-pressure roller press of claim 1 wherein said at least one product material admission comprises an admission opening in one of said lateral end walls.

20. The high-pressure roller press of claim 19 further comprising at least one admission opening in each of said lateral end walls.

21. The high-pressure roller press of claim 19 wherein said admission opening is located above said nip.

* * * * *